United States Patent [19]

Oase

[11] 4,245,440

[45] Jan. 20, 1981

[54] CABLE AND FABRIC ROOF STRUCTURE

[75] Inventor: Vernon S. Oase, Toledo, Ohio

[73] Assignee: Owens-Corning Fiberglas Corporation, Toledo, Ohio

[21] Appl. No.: 39,053

[22] Filed: May 14, 1979

[51] Int. Cl.[3] ..... E04B 1/34

[52] U.S. Cl. ..... 52/83; 16/87 R; 24/135 L; 52/2

[58] Field of Search ..... 24/135 L; 52/2, 80, 52/83, 63; 16/87 R

[56] References Cited

U.S. PATENT DOCUMENTS

| | | | |
|---|---|---|---|
| 320,235 | 6/1885 | Friedrick | 52/83 |
| 3,137,097 | 6/1964 | Zeinetz | 52/80 |
| 3,601,944 | 8/1971 | Shepherd | 52/83 |
| 3,835,603 | 9/1974 | Schnebel | 52/83 |
| 3,973,364 | 8/1976 | Seaman | 52/83 |
| 4,079,480 | 3/1978 | Oase | 52/584 |
| 4,184,294 | 1/1980 | Purvis | 52/83 |

*Primary Examiner*—John E. Murtagh

*Attorney, Agent, or Firm*—Ronald C. Hudgens; Philip R. Cloutier; Paul J. Rose

[57] ABSTRACT

The roof structure includes a pair of cables (10, 12) intersecting at right angles to provide four cable segments and four quadrants, and clamping means clamping adjacent corners of four fabric panels (80) in the four quadrants, the clamping means including four elongated base plates (24, 34, 44, 54) mounted respectively on the four cable segments, each base plate (24, 34, 44, 54) having a pair of elongated lower clamping plates (60, 70) extending respectively along opposite longitudinal edge portions thereof, and each lower clamping plate (60, 70) having an elongated upper clamping plate (64, 74) secured thereto and clamping an edge portion of one of the fabric panels (80) therebetween. Only one end portion of each of the base plates (24, 34, 44, 54) is secured to its cable segment, and clearances between parts adjacent the cable intersection allow a limited amount of relative movement between the parts to provide stress relief in the fabric panels (80).

6 Claims, 3 Drawing Figures

CABLE AND FABRIC ROOF STRUCTURE

This invention relates generally to fabric roof structures either of the type wherein cables under tension support roof fabric against the force of gravity or of the type wherein cables restrain air-supported roof fabric, and more specifically to fabric clamping apparatus at the intersection of two cables extending at right angles to each other.

An object of the invention is to provide a fabric roof structure including fabric clamping apparatus at the intersection of two cables, the clamping apparatus being designed to minimize or eliminate undesirable fabric stress.

Other objects and advantages will become apparent when the following specification is considered along with the accompanying drawings in which.

A fabric clamping system for fabric roofs is disclosed in my U.S. Pat. No. 4,079,480 issued Mar. 21, 1978. This patent discloses clamping means for clamping roof fabric on opposite sides and along the length of a suspended cable. The present application discloses clamping means for clamping roof fabric at the intersection of two cables extending at right angles to each other.

Figure 1:
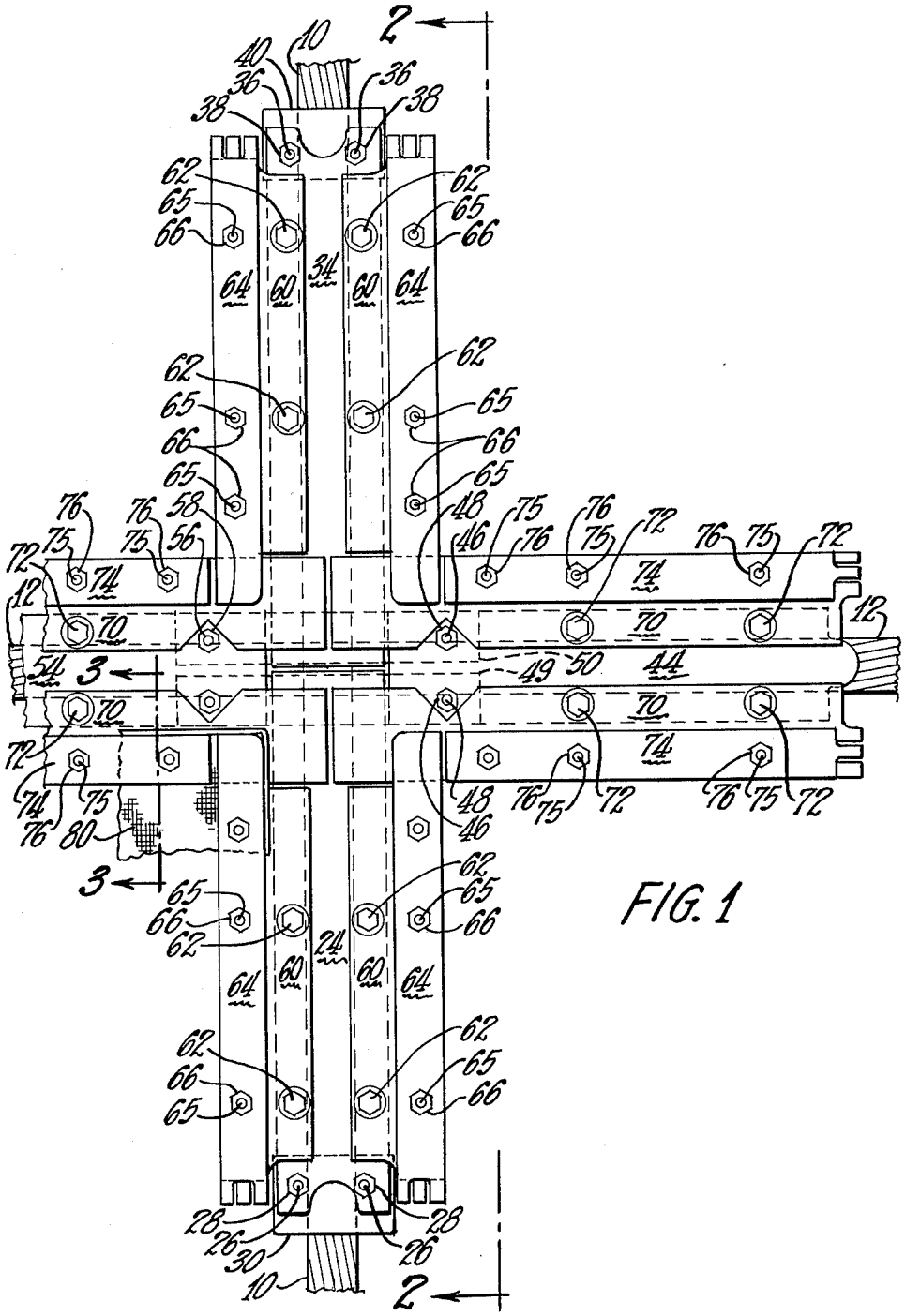
FIG. 1 is a fragmentary plan view of a cable and fabric roof structure constructed in accordance with the invention.
Figure 2:
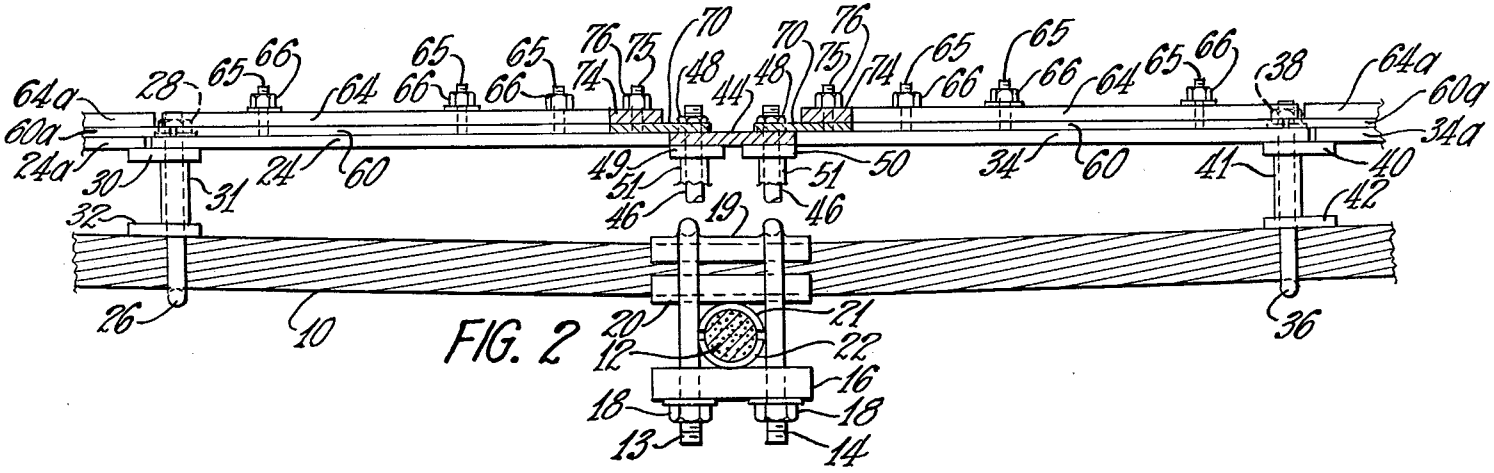
FIG. 2 is a vertical sectional view taken generally along the line 2—2 of FIG. 1.

With respect to the drawings, FIGS. 1 and 2 show a pair of cables 10 and 12 crossing at right angles to each other. The cables 10 and 12 are clamped together at their intersection by any suitable clamping means. For example, the clamping means may include a pair of U-bolts 13 and 14, a clamping block 16 having four apertures for respectively receiving the four leg portions of the two U-bolts 13 and 14, four nuts 18 of which two are shown, and four semicylindrical half-pipe sections 19, 20, 21, and 22 formed by bisecting pipe longitudinally. The half-pipe section 19 is welded to the bight portions of the U-bolts 13 and 14. The half-pipe sections 20 and 21 are welded to each other. The half-pipe section 22 is welded to the clamping block 16.

An elongated base plate 24 above the cable 10 and on one side of the cable 12 has an end portion remote from the cable 12 clamped to the cable 10 by clamping means which includes a U-bolt 26, a pair of nuts 28, a mounting plate 30, a pair of spacing sleeves 31 mounted respectively on the two leg portions of the U-bolt 26, and a cable clamping plate 32 similar to the plate 30. The plates 24, 30, and 32 each have a pair of apertures through which the leg portions of the U-bolt 26 respectively extend.

Similarly, an elongated base plate 34 above the cable 10 and on the other side of the cable 12 from the plate 24 has an end portion remote from the cable 12 clamped to the cable 10 by clamping means which includes a U-bolt 36, a pair of nuts 38, a mounting plate 40, a pair of spacing sleeves 41, and a cable clamping plate 42.

In a similar manner, an elongated base plate 44 above the cable 12 and on one side of the cable 10 has an end portion adjacent the cable 10 clamped to the cable 12 by clamping means which includes a U-bolt 46, a pair of nuts 48, a pair of parallel spaced elongated mounting straps 49 and 50, a pair of spacing sleeves 51 longer than the spacing sleeves 31 and 41 and mounted respectively on the two leg portions of the U-bolt 46, and a cable clamping plate (not shown) similar to the plates 32 and 42. The lower portion of the U-bolt 46 is broken away in FIG. 2 to show the U-bolts 13 and 14 more clearly, but it will be understood that the U-bolt 46 is longer than the U-bolts 26 and 36 because it is secured around the lower cable 12 rather than the upper cable 10. One leg portion of the U-bolt 46 passes through an end portion of the mounting strap 49 and the other leg portion passes through an end portion of the mounting strap 50.

An elongated base plate 54 above the cable 12 and on the other side of the cable 10 from the plate 44 has an end portion adjacent the cable 10 clamped to the cable 12 by clamping means which includes a U-bolt 56, a pair of nuts 58, the other end portions of the mounting starps 49 and 50, a pair of spacing sleeves (not shown) mounted respectively on the two leg portions of the U-bolt 56, and a cable clamping plate (not shown) similar to the plates 32 and 42.

The end portions of the base plates 24 and 34 adjacent the cable 12 rest respectively on central portions of the mounting straps 49 and 50 and are disposed between the clamped end portions of the base plates 44 and 54 adjacent the cable 10. The end portions of the base plates 44 and 54 remote from the cable 10 rest on mounting plates (not shown) similar to the mounting plates 30 and 40.

Each of the base plates 24 and 34 has a pair of elongated lower fabric clamping plates 60 secured thereto respectively along opposite longitudinal edge portions and on the upper side thereof. Each of the clamping plates 60 is secured by a pair of screws 62, transversely overhangs the respective longitudinal edge portion of its respective base plate 24 or 34, and has secured thereto on the upper side of its overhanging portion an elongated upper fabric clamping plate 64. Each plate 60 has a plurality of upwardly extending studs 65 mounted on its overhanging portion and spaced longitudinally therealong. Nuts 66 respectively mounted on the studs 65 secure the respective clamping plates 64 in place.

Each of the base plates 44 and 54 has a pair of elongated lower fabric clamping plates 70 secured thereto respectively along opposite longitudinal edge portions and on the upper side thereof. Each of the clamping plates 70 is secured by a pair of screws 72, transversely overhangs the respective longitudinal edge portion of it respective base plate 44 or 54, and has secured thereto on the upper side of its overhanging portion an elongated upper fabric clamping plate 74. Each plate 70 has a plurality of upwardly extending studs 75 mounted in its overhanging portion and spaced longitudinally therealong. Nuts 76 respectively mounted on the studs 75 secure the respective clamping plates 74 in place.

Adjacent the cable 10, the base plate 44 is spaced from the base plate 54, and the end portions of the base plates 24 and 34 adjacent the cable 12 are disposed therebetween where they respectively overlap the mounting plates 49 and 50. Adjacent the cable 12, the lower clamping plates 60 on the base plate 24 are spaced respectively from the lower clamping plates 60 on the base plate 34, and the lower clamping plates 70 on the base plates 44 and 54 are disposed therebetween where they overlap the end portions of the base plates 24 and 34 adjacent the cable 12. Adjacent the cable 10, the upper clamping plates 74 associated with the base plate 44 are spaced respectively from the upper clamping plates 74 associated with the base plate 54, and the upper clamping plates 64 respectively associated with the base plates 24 and 34 are disposed therebetween where they respectively overlap the end portions of the lower clamping plates 70 adjacent the cable 10. The lower clamping plates 70 on the base plate 44 are notched respectively to receive the nuts 48 on the U-bolt 46, and the lower clamping plates 70 on the base plate 54 are notched respectively to receive the nuts 58 on the U-bolt 56.

Figure 3:
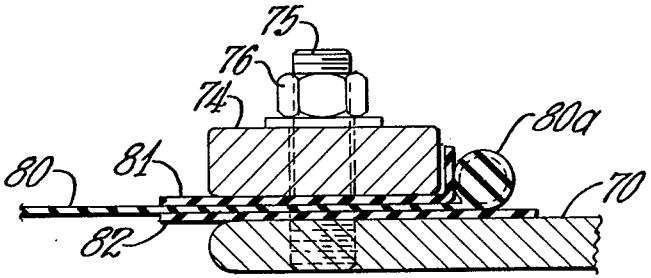
FIG. 3 is an enlarged fragmentary vertical sectional view taken generally along the line 3—3 of FIG. 1.

FIG. 1 shows a portion of a roof fabric panel 80 in a lower left quadrant of the cable intersection clamped at one edge between a lower clamping plate 60 and an upper clamping plate 64 on the base plate 24 and at another edge between a lower clamping plate 70 and an upper clamping plate 74 on the base plate 54. The panel 80 is provided at its edges with a bead portion 80*a* as better shown in FIG. 3. Upper gasket material 81 is provided between the panel 80 and the upper clamping plates 64 and 74. Lower gasket material 82 is provided between the panel 80 and the lower clamping plates 60 and 70. As will be understood, the bead portion 80*a* prevents the panel 80 from slipping out of the clamping plates. Preferably the panel 80 is a resin-coated woven glass fiber cloth. Four such panels, one in each quadrant around the cable intersection, are clamped between the upper and lower clamping plates.

As more fully explained in the above-mentioned U.S. Pat. No. 4,079,480, successive base plates and upper and lower clamping plates along a cable between cable intersections have interleaving end portions. As shown in FIG. 1 of this application, the base plates 24 and 34 have female end portions resting respectively on the mounting plates 30 and 40. The base plates 44 and 54 have male end portions remote from the cable 10, only the male end portion of the base plate 44 being shown. The lower clamping plates 60 have male end portions remote from the cable 12, while the lower clamping plates 70 have female end portions remote from the cable 10, only the female end portions on the plates 70 associated with the base plate 44 being shown. The upper clamping plates 64 have female end portions remote from the cable 12, while the upper clamping plates 74 have male end portions remote from the cable 10, only the male end portions on the plates 74 associated with the base plate 44 being shown.

FIG. 2 fragmentarily shows a base plate 24*a* having a male end portion, like that shown on the base plate 44, resting on the mounting plate 30 and interengaged with the clamped female end portion of the base plate 24. Similarly, a base plate 34*a* is fragmentarily shown and has a male end portion resting on the mounting plate 40 and interengaged with the clamped female end portion of the base plate 34. Lower clamping plates 60*a* and upper clamping plates 64*a* are fragmentarily shown respectively on the base plates 24*a* and 34*a* in FIG. 2, none of these being shown in FIG. 1 in order that the cable 10 could be shown.

Each of the base plates is secured to its cable by a U-bolt assembly at only one of its end portions, and at the cable intersection, as best shown in FIG. 1, there is horizontal clearance between adjacent parts. This allows a limited amount of relative movement between the parts and provides stress relief in the four fabric panels clamped at the cable intersection. Specifically, there is horizontal clearance between the base plates 24 and 34, and between each of these and the base plate 44 on one side of the base plate 54 on the other side. There is horizontal clearance between each lower clamping plate 70 on the base plate 44 and the lower clamping plate 70 on the base plate 54 aligned therewith longitudinally of the cable 12. There is horizontal clearance between each lower clamping plate 60 and the adjacent lower clamping plate 70. There is horizontal clearance between each upper clamping plate 64 and the adjacent upper clamping plate 74. Finally, the mounting straps 49 and 50 are made as two separate straps with clearance therebetween, rather than as one.

Various modifications may be made in the structure shown and described without departing from the spirit and scope of the invention.

I claim:

1. A cable and fabric roof structure comprising a pair of cables (10, 12) intersecting substantially at right angles to each other in plan view to provide four cable segments radiating from the cable intersection and dividing the area thereabout into four quadrants, one (12) of the cables being below the other (10), means (13, 14, 16, 18, 19, 20, 21, 22) securing the cables (10, 12) together at their intersection, and means above the cables (10, 12) adjacent their intersection clamping adjacent corners of four fabric panels (80) disposed respectively in the four quadrants, the clamping means comprising four elongated base plates (24, 34, 44, 54) mounted on and extending respectively along the four cable segments, four positive fastening means (26, 28, 36, 38, 46, 48, 56, 58) respectively securing the base plates (24, 34, 44, 54) to their cable segments, each positive fastening means securing the respective base plate to the respective cable segment at only one of two opposite end portions of the base plate, the fastening means (46, 48, 56, 58) for the two base plates (44, 54) on one (12) of the cables being disposed respectively at end portions thereof adjacent the other (10) of the cables and the fastening means (26, 28, 36, 38) for the two base plates (24, 34) on the other (10) of the cables being disposed respectively at end portions thereof remote from the one (12) of the cables, each base plate (24, 34, 44, 54) having a pair of elongated lower clamping plates (60, 70) secured thereto and extending respectively along opposite longitudinal edge portions thereof, and each lower clamping plate (60, 70) having an elongated upper clamping plate (64, 74) secured thereto and clamping an edge portion of one of the fabric panels (80) therebetween.

2. A cable and fabric roof structure as claimed in claim 1 wherein the adjacent end portions of the two base plates, (44, 54) on the one (12) of the cables are spaced apart and there are received therebetween adjacent end portions of the two base plates (24, 34) on the other (10) of the cables.

3. A cable and fabric roof structure as claimed in claim 2 including a mounting strap (49, 50) beneath and spanning the space between the adjacent end portions of the two base plates (44, 54) on the one (12) of the cables and secured thereto respectively at opposite end portions by the fastening means (46, 48, 56, 58) therefor.

4. A cable and fabric roof structure as claimed in claim 2 including a pair of spaced parallel mounting straps (49, 50) beneath and spanning the space between the adjacent end portions of the two base plates (44, 54) on the one (12) of the cables and each being secured thereto respectively at opposite end portions by the fastening means (46, 48, 56, 58) therefor.

5. A cable and fabric roof structure as claimed in claim 4 wherein the two lower clamping plates (60) on one (24) of the base plates on the other (10) of the cables are spaced apart from the two lower clamping plates

(60) on the other (34) of the base plates on the other (10) of the cables and there are received therebetween adjacent end portions of the lower clamping plates (70) on the two base plates (44, 54) on the one (12) of the cables, and each of the two lower clamping plates (70) on each of the two base plates (44, 54) on the one (12) of the cables overlaps an end portion of one of the two base plates (24, 34) on the other (10) of the cables.

6. A cable and fabric roof structure as claimed in claim 5 wherein the two upper clamping plates (74) connected to one (44) of the base plates on the one (12) of the cables are spaced apart from the two upper clamping plates (74) connected to the other (54) of the base plates on the one (12) of the cables and there are received therebetween adjacent end portions of the upper clamping plates (64) connected to the two base plates (24, 34) on the other (10) of the cables, and each of the two upper clamping plates (64) connected to each of the two base plates (24, 34) on the other (10) of the cables overlaps one of the lower clamping plates (70) on one of the base plates (44, 54) on the one (12) of the cables.

* * * * *